US006346129B1

(12) United States Patent
Sabourin et al.

(10) Patent No.: US 6,346,129 B1
(45) **Date of Patent: *Feb. 12, 2002**

(54) FUEL COMPOSITIONS CONTAINING HYDROXYALKYL-SUBSTITUTED POLYAMINES

(75) Inventors: Edward T. Sabourin, Novato; Thomas F. Buckley, III, El Sobrante; Curtis B. Campbell, Hercules; Frank Plavac, Mill Valley; Mary J. Tompkins, deceased, late of San Rafael, all of CA (US), by Michael A. Shippey, legal representative

(73) Assignee: Chevron Oronite Company LLC, San Ramon, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/384,059

(22) Filed: Feb. 6, 1995

Related U.S. Application Data

(63) Continuation of application No. 07/634,645, filed on Dec. 27, 1990, now abandoned.

(51) Int. Cl.[7] ..... C10L 1/18; C10L 1/22
(52) U.S. Cl. ..... 44/433; 44/434
(58) Field of Search ..... 44/433, 434

(56) References Cited

U.S. PATENT DOCUMENTS

| | | | | | |
|---|---|---|---|---|---|
| 2,856,363 | A | * | 10/1958 | Brennan | 252/33.6 |
| 3,063,819 | A | * | 11/1962 | Watt | 44/434 |
| 3,120,429 | A | * | 2/1964 | Towle | 44/434 |
| 3,438,757 | A | | 4/1969 | Honnen et al. | 44/58 |
| 3,565,804 | A | | 2/1971 | Honnen et al. | 252/50 |
| 3,574,576 | A | | 4/1971 | Honnen et al. | 44/72 |
| 3,681,463 | A | * | 8/1972 | Lee | 44/434 |
| 3,794,586 | A | | 2/1974 | Kimura et al. | 252/51.5 R |
| 3,898,056 | A | | 8/1975 | Honnen | 44/58 |
| 3,960,515 | A | | 6/1976 | Homen | 44/58 |
| 4,055,402 | A | * | 10/1977 | Battersby et al. | 44/433 |
| 4,108,613 | A | * | 8/1978 | Frost | 44/434 |
| 4,123,232 | A | * | 10/1978 | Frost | 44/434 |
| 4,152,499 | A | * | 5/1979 | Boerzel et al. | 252/51.5 A |
| 4,410,335 | A | | 10/1983 | Childs | 44/72 |
| 4,605,808 | A | * | 8/1986 | Samson | 585/525 |
| 4,816,037 | A | * | 3/1989 | Horodysky | 44/434 |
| 4,832,702 | A | * | 5/1989 | Kummer et al. | |

FOREIGN PATENT DOCUMENTS

| | | | |
|---|---|---|---|
| EP | 0476485 | 3/1992 | C10L/1/22 |

* cited by examiner

*Primary Examiner*—Margaret Medley
(74) *Attorney, Agent, or Firm*—C. J. Caroli

(57) ABSTRACT

A fuel composition comprising a major amount of hydrocarbons boiling in the gasoline or diesel range and an effective detergent amount of a hydroxyalkyl-substituted polyamine which is the reaction product of:

(a) a polyolefin epoxide derived from a branched chain polyolefin having an average molecular weight of about 400 to 5,000; and (b) a polyamine having from 2 to about 12 amine nitrogen atoms and from 2 to about 40 carbon atoms.

6 Claims, No Drawings

FUEL COMPOSITIONS CONTAINING HYDROXYALKYL-SUBSTITUTED POLYAMINES

CROSS-REFERENCE TO RELATED APPLICATIONS

This application is a continuation of Application Ser. No. 07/634,645, filed Dec. 27, 1990, and now abandoned.

BACKGROUND OF THE INVENTION

1. Field of the Invention

In recent years, numerous fuel detergents or "deposit control" additives have been developed. These materials when added to hydrocarbon fuels employed in internal combustion engines effectively reduce deposit formation which ordinarily occurs in carburetor ports, throttle bodies, ventures, intake ports and intake valves. The reduction of these deposit levels has resulted in increased engine efficiency and a reduction in the level of hydrocarbon and carbon monoxide emissions.

Due to the synthetic procedures employed in the manufacture of many of these deposit control additives, such additives often contain small amounts of residual chlorine. In the past, the amount of residual chlorine contained in these additives was usually considered insignificant in comparison to other sources of chlorine typically present in leaded fuels. However, with the advent of non-leaded gasolines, it has become possible to remove many of these other chlorine sources found in fuels. The removal of chlorine from fuels is particularly advantageous, since the combustion process may convert the chlorine into environmentally undesirable emission products.

It is, therefore, highly desirable to provide fuel compositions which contain deposit control additives which effectively control deposits in intake systems (carburetor, valves, etc.) of engines operated with fuels containing them, but do not contribute to chlorine-containing emissions.

2. Description of the Prior Art

U.S. Pat. Nos. 3,438,757 and 3,574,576 to Honnen et al. disclose high molecular weight branched chain aliphatic hydrocarbon N-substituted amines and alkylene polyamines which are useful as detergents and dispersants in hydrocarbonaceous liquid fuels for internal combustion engines. These hydrocarbyl amines and polyamines have molecular weights in the range of about 425 to 10,000, and more usually in the range of about 450 to 5,000. Such high molecular weight hydrocarbyl polyamines are also taught to be useful as lubricating oil additives in U.S. Pat. No. 3,565,804 to Honnen et al.

U.S. Pat. Nos. 3,898,056 and 3,960,515 to Honnen et al. disclose a mixture of high and low molecular weight hydrocarbyl amines used as detergents and dispersants at low concentrations in fuels. The high molecular weight hydrocarbyl amine contains at least one hydrocarbyl group having a molecular weight from about 1,900 to 5,000 and the low molecular weight hydrocarbyl amine contains at least one hydrocarbyl group having a molecular weight from about 300 to 600. The weight ratio of low molecular weight amine to high molecular weight amine in the mixture is maintained between about 0.5:1 and 5:1.

U.S. Pat. Nos. 4,123,232 and 4,108,613 to Frost disclose pour point depressants for hydrocarbonaceous fuels which are the reaction products of an epoxidized alpha olefin containing from 14 to 30 carbon atoms and a nitrogen-containing compound selected from an amine, a polyamine and a hydroxyalkyl amine.

U.S. Pat. No. 3,794,586 to Kimura et al. discloses lubricating oil compositions containing a detergent and antioxidant additive which is a hydroxyalkyl-substituted polyamine prepared by reacting a polyolefin epoxide derived from branched-chain olefins having an average molecular weight of 140 to 3000 with a polyamine selected from alkylene diamines, cycloalkylene diamines, aralkylene diamines, polyalkylene polyamines and aromatic diamines, at a temperature of 15 to 180° C.

SUMMARY OF THE INVENTION

A fuel composition is provided which contains a deposit control additive which aids the composition in maintaining cleanliness of engine intake systems and advantageously contains no residual chlorine. Accordingly, the novel fuel composition of the invention comprises a major amount of hydrocarbons boiling in the gasoline or diesel range and an effective detergent amount of a hydroxyalkyl-substituted polyamine which is the reaction product of (a) a polyolefin epoxide derived from a branched chain polyolefin having an average molecular weight of about 400 to 5,000, and (b) a polyamine having from 2 to about 12 amine nitrogen atoms and from 2 to about 40 carbon atoms.

The present invention further provides a fuel concentrate comprising an inert stable oleophilic organic solvent boiling in the range of from about 150° F. to 400° F. and from 10 to 50 weight percent of the hydroxyalkyl-substituted polyamine reaction product described above.

DETAILED DESCRIPTION OF THE INVENTION

The hydroxyalkyl-substituted polyamine additive employed in the fuel composition of the present invention comprises the reaction product of (a) a polyolefin epoxide derived from a branched chain polyolefin having an average molecular weight of about 400 to 5,000 and (b) a polyamine having from 2 to about 12 amine nitrogen atoms and from 2 to about 40 carbon atoms. The polyamine component of this reaction product is selected to provide solubility in the fuel composition and deposit control activity without octane requirement increase.

The Polyolefin Epoxide Component

The polyolefin epoxide component of the presently employed hydroxyalkyl-substituted polyamine reaction product is obtained by oxidizing a polyolefin with an oxidizing agent to give an alkylene oxide, or epoxide, in which the oxirane ring is derived from oxidation of the double bond in the polyolefin.

The polyolefin starting material used in the preparation of the polyolefin epoxide is a high molecular weight branched chain polyolefin having an average molecular weight of about 400 to 5,000, and preferably from about 900 to 2,500.

Such high molecular weight polyolefins are generally mixtures of molecules having different molecular weights and can have at least one branch per 6 carbon atoms along the chain, preferably at least one branch per 4 carbon atoms along the chain, and particularly preferred that there be about one branch per 2 carbon atoms along the chain. These branched chain olefins may conveniently comprise polyolefins prepared by the polymerization of olefins of from 2 to 6 carbon atoms, and preferably from olefins of from 3 to 4 carbon atoms, and more preferably from propylene or isobutylene. When ethylene is employed, it will normally be copolymerized with another olefin so as to provide a branched chain polyolefin. The addition-polymerizable olefins employed are normally 1-olefins. The branch may be of from 1 to 4 carbon atoms, more usually of from 1 to 2 carbon atoms, and preferably methyl.

In general, any high molecular weight branched chain polyolefin isomer whose epoxide is capable of reacting with a polyamine is suitable for use in preparing the presently employed fuel additives. However, sterically hindered epoxides, such as tetra-alkyl substituted epoxides, are generally slower to react.

Particularly preferred polyolefins are those containing an alkylvinylidene isomer present in an amount at least about 20%, and preferably at least 50%, of the total polyolefin composition. The preferred alkylvinylidene isomers include methylvinylidene and ethylvinylidene, more preferably the methylvinylidene isomer.

The especially preferred high molecular weight polyolefins used to prepare the instant polyolefin epoxides are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 30, a polyisobutene having a molecular weight of about 1300 and a methylvinylidene content of about 76%, available from British Petroleum.

As noted above, the polyolefin is oxidized with a suitable oxidizing agent to provide an alkylene oxide, or polyolefin epoxide, in which the oxirane ring is formed from oxidation of the polyolefin double bond.

The oxidizing agent employed may be any of the well known conventional oxidizing agents used to oxidize double bonds. Suitable oxidizing agents include hydrogen peroxide, peracetic acid, perbenzoic acid, performic acid, monoperphthalic acid, percamphoric acid, persuccinic acid and pertrifluoroacetic acid. The preferred oxidizing agent is peracetic acid.

When peracetic acid is used as the oxidizing agent, generally a 40% peracetic acid solution and about a 5% equivalent of sodium acetate (as compared to the peracetic acid) is added to the polyolefin in a molar ratio of per-acid to olefin in the range of about 1.5:1 to 1:1, preferably about 1.2:1. The mixture is gradually allowed to react at a temperature in the range of about 20° C. to 90° C.

The resulting polyolefin epoxide, which is isolated by conventional techniques, is generally a liquid or semi-solid resin at room temperature, depending on the type and molecular weight of olefin employed.

Amine Component

The amine component of the presently employed hydroxylalkyl-substituted polyamine reaction product is preferably derived from a polyamine having from 2 to about 12 amine nitrogen atoms and from 2 to about 40 carbon atoms. The polyamine is reacted with a polyolefin epoxide to produce the hydroxyalkyl-substituted polyamine fuel additive finding use within the scope of the present invention. The polyamine, encompassing diamines, provides a reaction product with, on the average, at least about one basic nitrogen atom per product molecule, i.e., a nitrogen atom titratable by a strong acid. The polyamine preferably has a carbon-to-nitrogen ratio of from about 1:1 to 10:1.

The polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

Hydrocarbyl, as used in describing all the components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such 2-hydroxyethyl, 3-hydroxypropyl, hydroxy-isopropyl, h4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (C) are such as propionyl, acetyl, etc. The more preferred substituents are hydrogen, $C_1$–$C_6$ alkyls and $C_1$–$C_6$ hydroxyalkyls.

In a substituted polyamine the substituents are found at any atom capable of receiving them. The substituted atoms, e.g., substituted nitrogen atoms, are generally geometrically inequivalent, and consequently the substituted amines finding use in the present invention can be mixtures of mono- and poly-substituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene) triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the $C_2$–$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. A particularly preferred polyalkylene polyamine is diethylene triamine.

The amine component of the presently employed fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (A), (B), (C) and (D). The heterocyclic compounds are exemplified by piperazines, such a 2-methylpiperazine, N-(2-hydroxyethyl)-piperazine, 1,2-bis-(N-piperazinyl) ethane and N,N'-bis(N-piperazinyl)piperazine, 2-methylimidazoline, 3-amino-piperidine, 3-aminopyridine, N-(3-aminopropyl)-morpholine, etc. Among the heterocyclic compounds the piperazines are preferred.

Typical polyamines that can be used to form the additives employed in this invention by reaction with a polyolefin epoxide include the following: ethylene diamine, 1,2-propylene diamine, 1,3-propylene diamine, diethylene triamine, triethylene tetraamine, hexamethylene diamine, tetraethylene pentamine, dimethylaminopropylene diamine, N-(beta-aminoethyl)piperazine, N-(beta-aminoethyl) piperadine, 3-amino-N-ethylpiperidine, N-(beta-aminoethyl) morpholine, N,N'-di(beta-aminoethyl) piperazine, N,N'-di(beta-aminoethyl)imidazolidone-2, N-(beta-cyanoethyl) ethane-1,2-diamine, 1-amino-3,6,9-triazaoctadecane, 1-amino-3,6-diaza-9-oxadecane, N-(beta-aminoethyl) diethanolamine, N'-acetylmethyl-N-(beta-aminoethyl) ethane-1,2-diamine, N-acetonyl-1,2-propanediamine, N-(beta-nitroethyl)-1,3-propane diamine, 1,3-dimethyl-5-(beta-aminoethyl)hexahydrotriazine, N-(beta-aminoethyl)-hexahydrotriazine, 5-(beta-aminoethyl)-1,3,5-dioxazine, 2-(2-aminoethylamino)-ethanol, and 2-[2-(2-aminoethylamino) ethylamino]-ethanol.

In many instances the amine used as a reactant in the production of the fuel additive employed in the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds of this invention, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99–116.

Preparation of the Hydroxyalkyl-Substituted Polyamine Reaction Product

As noted above, the fuel additive finding use in the present invention is a hydroxyalkyl-substituted polyamine which is the reaction product of (a) a polyolefin epoxide derived from a branched chain polyolefin having an average molecular weight of about 400 to 5,000 and (b) a polyamine having from 2 to about 12 amine nitrogen atoms and from 2 to about 40 carbon atoms.

The reaction of the polyolefin epoxide and the polyamine is generally carried out either neat or with a solvent at a temperature in the range of about 100° C. to 250° C. and preferably from about 180° C. to about 220° C. The reaction usually is conducted in the absence of oxygen, and may be carried out in the presence or absence of a catalyst. The desired product may be obtained by water wash and stripping, usually by aid of vacuum, of any residual solvent.

The mole ratio of basic amine nitrogen to polyolefin epoxide will generally be in the range of about 3 to 50 moles of basic amine nitrogen per mole of epoxide, and more usually about 5 to 20 moles of basic amine nitrogen per mole of epoxide. The mole ratio will depend upon the particular amine and the desired ratio of epoxide to amine. Since suppression of polysubstitution of the polyamine is usually desired, large mole excesses of the polyamine will generally be used.

The reaction of polyolefin epoxide and polyamine may be conducted either in the presence or absence of a catalyst. When employed, suitable catalysts include Lewis acids, such as aluminum trichloride, boron trifluoride, titanium tetrachloride, ferric chloride, and the like. Other useful catalysts include solid catalysts containing both Bronsted and Lewis acid sites, such as alumina, silica, silica-alumina, and the like.

The reaction may also be carried out with or without the presence of a reaction solvent. A reaction solvent is generally employed whenever necessary to reduce the viscosity of the reaction product. These solvents should be stable and inert to the reactants and reaction product. Preferred solvents include aliphatic or aromatic hydrocarbons or aliphatic alcohols.

Depending on the temperature of the reaction, the particular polyolefin epoxide used, the mole ratios and the particular polyamine, as well as the presence or absence of a catalyst, the reaction time may vary from less than 1 hour to about 72 hours.

After the reaction has been carried out for a sufficient length of time, the reaction mixture may be subjected to extraction with a hydrocarbon-water or hydrocarbon-alcohol-water medium to free the product from any low-molecular weight amine salts which have formed and any unreacted polyamines. The product may then be isolated by evaporation of the solvent.

In most instances, the additive compositions used in this invention are not a pure single product, but rather a mixture of compounds having an average molecular weight. Usually, the range of molecular weights will be relatively narrow and peaked near the indicated molecular weight. Similarly, for the more complicated polyamines, the compositions will be a mixture of amines having as the major product the compound indicated as the average composition and having minor amounts of analogous compounds relatively close in compositions to the dominant compound.

Fuel Compositions

The hydroxyalkyl-substituted polyamine additive will generally be employed in a hydrocarbon distillate fuel. The proper concentration of additive necessary in order to achieve the desired detergency and dispersancy varies depending upon the type of fuel employed, the presence of other detergents, dispersants and other additives, etc. Generally, however, from 30 to 2000 weight ppm, preferably from 100 to 500 ppm of hydroxyalkyl-substituted polyamine per part of base fuel is needed to achieve the best results. When other detergents are present, a lesser amount of additive may be used. For performance as a carburetor detergent only, lower concentrations, for example 30 to 70 ppm may be preferred.

The deposit control additive may be formulated as a concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of the additive will be ordinarily at least 10% by weight and generally not exceed 70% by weight, preferably 10–50 wt. % and most preferably from 10 to 25 wt. %.

In gasoline fuels, other fuel additives may also be included such as antiknock agents, e.g., methylcyclopentadienyl manganese tricarbonyl, tetramethyl or tetraethyl lead, or other dispersants or detergents such as various substituted succinimides, amines, etc. Also included may be lead scavengers such as aryl halides, e.g., dichlorobenzene or alkyl halides, e.g., ethylene dibromide. Additionally, antioxidants, metal deactivators and demulsifiers may be present.

A particularly useful additive is a fuel-soluble carrier oil. Exemplary carrier oils include nonvolatile poly (oxyalkylene) compounds; other synthetic lubricants or lubricating mineral oil. Preferred carrier oils are poly (oxyalkylene) alcohols, diols (glycols and polyols used singly or in mixtures, such as the Pluronics marketed by BASF Wyandotte Corp., and the UCON LB-series fluids marketed by Union Carbide Corp. When used, these carrier oils are believed to act as a carrier for the detergent and assist in removing and retarding deposits. They have been found to display synergistic effects when combined with certain hydrocarboxypoly(oxyalkylene) aminocarbamates. They are employed in amounts from about 0.005 to 0.5 percent by volume, based on the final gasoline composition. Preferably 100–5000 ppm by weight of a fuel soluble poly (oxyalkylene) alcohol, glycol or polyol is used as carrier oil. In the previously described concentrate the poly (oxyalkylene) alcohol, diols (glycols) and polyols are usually present in amounts of from 5 to 80 percent by weight. A particularly preferred poly(oxyalkylene) carrier oil is poly(oxypropylene) alcohol, glycol or polyol, especially the alcohol, e.g., a ($C_1$–$C_{10}$hydrocarbyl)poly(oxypropylene) alcohol.

EXAMPLES

The following examples are presented to illustrate specific embodiments of the practice of this invention and should not be interpreted as limitations upon the scope of the invention.

Example 1

Epoxidation Of Ultravis 30 Polyisobutene

A 2 liter, three-necked flask equipped with a mechanical stirrer and a heating mantle was charged with 687 grams of Ultravis 30 polyisobutene (mol. wt. 1300, 76% methylvinylidene, available from British Petroleum) and 550 ml. of hexane. A mixture of 4.2 grams sodium acetate trihydrate and 150.5 grams 40% peracetic acid was added dropwise while maintaining the temperature between 35° C. and 45° C. The addition was complete in about one hour. The temperature was maintained for an additional 5 hours and the mixture was then allowed to cool overnight. The remaining acetic and peracetic acid mixture was siphoned off. Aqueous 5% sodium carbonate, 200 ml., was added cautiously to avoid excessive foaming. The mixture was transferred to a separatory funnel to remove the aqueous layer. The product was dried over anhydrous sodium sulfate, filtered, and solvent stripped to give 670 grams of product. Flash chromatography on Davison 62silica gel indicated that the product was 85% epoxide and 15% unreacted polybutene. The partially converted epoxide, 442 grams in 500 ml hexane, was reacted further with a mixture of 48.5 grams of 40% peracetic acid and 1.4 grams of sodium acetate trihydrate at 45° C. for 16 hours. When isolated as above, 424 grams of 98+% epoxide product was obtained.

Example 2

Epoxidation Of Parapol 1300 Polyisobutene

In a manner similar to the procedure of Example 1, 663 grams of Parapol 1300 polyisobutene (mol. wt. 1300, about 40% internal 2-olefin, available from Exxon Chemical Company) in 500 ml hexane was reacted with 147 grams of 40% peracetic acid containing 4.1 grams of sodium acetate trihydrate. The temperature was maintained at 44° C.–62° C. for 19 hours. When isolated as in Example 1, 650 grams of 95+% epoxide product was obtained.

Example 3

Reaction Of Polyisobutene Epoxide With Diethylene Triamine

A commercially available polyisobutene epoxide, Actipol E16 (mol. wt. 950, available from Amoco Chemical Company), 11.6 grams, was mixed with excess diethylenetriamine, 50 ml. Boron trifluoride etherate, 1 ml, was added and the mixture refluxed (200° C.) for 24 hours. The resulting mixture was diluted with an equal volume of water and extracted with dichloromethane. The extract was washed once with water, dried over anhydrous sodium sulfate and stripped of solvent on a rotary evaporator. The resulting crude product had a nitrogen content of 2.18%. A portion of the crude product was subjected to flash chromatography on silica gel. Elution with hexane gave a small amount of polybutene. Elution with hexane-diethyl ether (1:1) gave some unreacted epoxide. Elution with a mixture of hexane: diethyl ether: methanol: isopropylamine (8:8:3:1) produced a hydroxyalkyl amine product containing 2.97% nitrogen.

Example 4

Reaction Of Polyisobutene Epoxide With Diethylene Triamine

Under a nitrogen atmosphere, 25 grams of Actipol E23 (mol. wt.=1300) polyisobutene epoxide, available from Amoco Chemical Company, and 90 ml diethylenetriamine were refluxed at 200° C. for 24 hours. Agitation was supplied by a magnetic stirrer. When isolated as in Example 3, 25.1 grams of crude product containing 1.28% nitrogen was obtained. Flash chromatography as above produced a fraction containing 2.78% nitrogen. This corresponded to 46% actives in the crude product, that is, 46% of the desired hydroxyamine adduct.

Example 5

Reaction Of Polyisobutene Epoxide With Diethylene Triamine

In a manner similar to Examples 3 and 4, 61.1 grams of 98+% purity polyisobutene epoxide prepared from Ultravis 30 polyisobutene was reacted with 200 ml of diethylenetriamine at reflux under nitrogen for 16 hours. Upon work-up, 60 grams of crude product with a nitrogen content of 2.05% was obtained. Flash chromatography produced a fraction containing 3.0% nitrogen. This corresponded to 68% actives in the crude product.

Example 6

Reaction Of Polyisobutene Epoxide With Diethylene Triamine

In a manner similar to Examples 3 to 5, 19.9 grams of 95+% polyisobutene epoxide prepared from Parapol 1300 polyisobutene was reacted with 30 ml diethylenetriamine for 16 hours at reflux. The resulting crude product, 19.8 grams, had a nitrogen content of 1.29%. Flash chromatography yielded a material with a nitrogen content of 3.12%. This corresponded to 41% actives in the crude product.

Example 7

Reaction Of Polyisobutene Epoxide With Ethylene Diamine

A 33.5 gram portion of Actipol E23 polyisobutene epoxide and 34 grams of ethylene diamine were placed in a Teflon-lined stainless steel reaction vessel, purged with nitrogen and sealed. The reaction vessel was placed in an oven at 200° C. for 24 hours with no stirring. When isolated as above, 33 grams of crude product containing 27% of the desired hydroxyamine adduct was obtained.

Example 8

Reaction of Polyisobutene Epoxide With Ethylene Diamine

In a manner similar to Example 7, 40.2 grams of Ultravis 30 polyisobutene epoxide was reacted with 35 grams of ethylene diamine to give a crude product containing 58% of the desired hydroxyamine adduct.

Example 9

Deposit Control Evaluation

In the following tests the hydroxyalkyl-substituted polyamines were blended in gasoline and their deposit control capacity tested in an ASTM/CFR Single-Cylinder Engine Test.

In carrying out the tests, a Waukesha CFR single-cylinder engine is used. The run is carried out for 15 hours, at the end of which time the intake valve is removed, washed with hexane and weighed. The previously determined weight of the clean valve is subtracted from the weight of the valve. The difference between the two weights is the weight of the deposit with a lesser amount of deposit measured connoting a superior additive. The operating conditions of the test are as follows: water jacket temperature 100° C. (212° F.); manifold vacuum of 12 in. Hg; intake mixture temperature 50.2° C. (125° F.); air-fuel ratio of 12; ignition spark timing of 40° BTC; engine speed is 1800 rpm; the crankcase oil is a commercial 30 W oil. The amount of carbonaceous deposit in milligrams on the intake valves is measured and reported in the following Table I.

The base fuel tested in the above test is a regular octane unleaded gasoline containing no fuel deposit control additive. The base fuel is admixed with the various additives at 100 ppma (parts per million of actives), along with 400 ppm Chevron 500R carrier oil. Also presented in Table I for comparison purposes are values for a commercially available nitrogen-containing deposit control additive having recognized performance in the field.

The data in Table I show that the hydroxyalkyl-substituted polyamine additives employed in the present invention are at least as effective deposit control additives as the recognized commercial additive and in some cases are markedly superior in performance to the commercial additive.

TABLE I

| Additive Sample 100 ppma + 400 ppm Chevron 500R oil | Intake Valve Deposit Weight milligrams | | | |
|---|---|---|---|---|
| | Run 1 | Run 2 | Run 3 | Average |
| Example No. 3 | | | | |
| crude | — | | | |
| chromatographed | 119.1 | | | |
| Example No. 4 | | | | |
| crude | 28.4 | | | |
| chromatographed | 6.9 | 1.0 | | |
| Example No. 5 | | | | |
| crude | 42.3 | | | |
| chromatographed | 7.8 | | | |
| Example No. 6 | | | | |
| crude | 95.8 | 60.0 | | |
| chromatographed | 112.0 | — | | |
| Example No. 7 | | | | |
| crude | — | | | |
| chromatographed | 110.2 | | | |
| Commercial Additive | 104.5 | 97.3 | 132.8 | 111.5 |
| BASE FUEL | 182.7 | | | |

What is claimed is:

1. A fuel composition comprising a major amount of hydrocarbons boiling in the gasoline or diesel range and an effective detergent amount of a hydroxyalkyl-substituted polyamine which is the reaction product of:

(a) polyolefin epoxide derived from a polyisobutylene having an average molecular weight of about 900 to 2,500 and containing at least 70% of a methylvinylidene isomer; and (b) a polyamine having from 2 to about 12 amine nitrogen atoms and from 2 to about 40 carbon atoms.

2. The composition according to claim 1, wherein said composition contains about 30 to 2000 weight ppm of the hydroxyalkyl-substituted polyamine.

3. The composition according to claim 1, wherein said composition contains about 100 to 500 weight ppm of the hydroxyalkyl-substituted polyamine.

4. The composition according to claim 1, wherein the polyamine is a polyalkylene polyamine wherein the alkylene group contains from 2 to 6 carbon atoms and the polyalkylene polyamine contains from 2 to 12 nitrogen atoms and from 2 to 24 carbon atoms.

5. The composition according to claim 4, wherein the polyalkylene polyamine is selected from the group consisting of ethylene diamine, polyethylene polyamine, propylene diamine and polypropylene polyamine.

6. The composition according to claim 5, wherein the polyalkylene polyamine is diethylene triamine.

* * * * *